US009039849B2

(12) United States Patent
Park et al.

(10) Patent No.: US 9,039,849 B2
(45) Date of Patent: May 26, 2015

(54) PREPARATION METHOD OF NANOCRYSTALLINE TITANIUM ALLOY AT LOW STRAIN

(75) Inventors: Chan Hee Park, Pohang-si (KR); Chong Soo Lee, Pohang-si (KR); Sung Hyuk Park, Busan (KR); Young Soo Chun, Pohang-si (KR)

(73) Assignee: POSTECH ACADEMY-INDUSTRY FOUNDATION, Pohang-si, Gyeongsangbuk-do (KR)

( * ) Notice: Subject to any disclaimer, the term of this patent is extended or adjusted under 35 U.S.C. 154(b) by 90 days.

(21) Appl. No.: 13/394,195

(22) PCT Filed: Nov. 30, 2009

(86) PCT No.: PCT/KR2009/007069

§ 371 (c)(1),
(2), (4) Date: Mar. 5, 2012

(87) PCT Pub. No.: WO2011/027943

PCT Pub. Date: Oct. 3, 2011

(65) Prior Publication Data

US 2012/0160378 A1 Jun. 28, 2012

(30) Foreign Application Priority Data

Sep. 7, 2009 (KR) ..... 10-2009-0083931

(51) Int. Cl.
*C22C 14/00* (2006.01)

(52) U.S. Cl.
CPC ..... *C22C 14/00* (2013.01)

(58) Field of Classification Search
USPC ..... 148/670
See application file for complete search history.

(56) References Cited

U.S. PATENT DOCUMENTS

| | | | | |
|---|---|---|---|---|
| 6,399,215 | B1 | 6/2002 | Zhu et al. | |
| 2006/0213592 | A1 | 9/2006 | Ko et al. | |
| 2006/0278308 | A1 * | 12/2006 | Shankar et al. | 148/513 |

FOREIGN PATENT DOCUMENTS

| | | | |
|---|---|---|---|
| KR | 10-1995-0006257 | B1 | 6/1995 |
| KR | 10-1996-0007428 | B1 | 5/1996 |
| KR | 10-0666478 | B1 | 5/1996 |
| KR | 10-2006-0087077 | A | 8/2006 |

OTHER PUBLICATIONS

Li et al. "Fatigue properties of a metastable b-type titanium alloy with reversible phase transformation." Shenyang National Laboratory for Materials Science, Institute of Metal Research, Chinese Academy of Sciences. May 2007.*

* cited by examiner

*Primary Examiner* — Kaj K Olsen
*Assistant Examiner* — Alexander Polyansky
(74) *Attorney, Agent, or Firm* — Sherr & Jiang, PLLC

(57) ABSTRACT

Provided is a method of preparing a nanocrystalline titanium alloy at low strain to have better strength. The present invention is characterized in that an initial microstructure is induced as martensites having a fine layered structure, and then a nanocrystalline titanium alloy is prepared at low strain by optimizing process variables through observation of the effects of strain, strain rate, and deformation temperature on the changes in the microstructure.

3 Claims, 6 Drawing Sheets

PREPARATION METHOD OF NANOCRYSTALLINE TITANIUM ALLOY AT LOW STRAIN

CROSS REFERENCE TO PRIOR APPLICATIONS

This application is a National Stage Patent Application of PCT International Patent Application No. PCT/KR2009/007069 (filed on Nov. 30, 2009) under 35 U.S.C. §371, which claims priority to Korean Patent Application No. 10-2009-0083931 (filed on Sep. 7, 2009), which are all hereby incorporated by reference in their entirety.

TECHNICAL FIELD

The present invention relates to a method of expanding applications of a nanocrystalline titanium alloy and simultaneously, improving strength and fatigue properties thereof by preparing the nanocrystalline titanium alloy at low strain.

BACKGROUND ART

Various methods have been suggested as a method of refining grains of a titanium alloy. Recently, a method of refining grains of a titanium alloy by using equal channel angular pressing (ECAP) was disclosed in Korean Patent Application Laid-Open Publication No. 10-2006-0087077 (Aug. 2, 2006), a prior application by the present applicant.

The content of this patent relates to a method of preparing a nanocrystalline titanium alloy having excellent properties by performing ECAP on a titanium alloy material and a nanocrystalline titanium alloy prepared thereby. In the method of preparing a nanocrystalline titanium alloy of the foregoing patent, the titanium alloy material is processed by being introduced into a bent channel of an ECAP apparatus. When this is described in more detail, ECAP under a constant temperature condition is performed at least twice on the titanium alloy material. Herein, when the ECAP is performed after the second ECAP, the titanium alloy material is introduced in a state of being rotated with respect to the previous ECAP based on a central axis passing the center of the channel inlet and processed.

However, the foregoing method is a method of refining grains of a titanium alloy by applying high strain ranging from 4 to 8. A technique for refining grains at low strain is required for expanding applications of a nanocrystalline titanium alloy.

DISCLOSURE OF THE INVENTION

Technical Problem

The purpose of the present invention is to prepare a titanium alloy having nanograins at low strain and to obtain better strength.

Technical Solution

An initial microstructure is induced as martensites having a fine layered structure, and then a nanocrystalline titanium alloy is prepared at low strain by optimizing process variables through observation of the effects of strain, strain rate, and deformation temperature on the changes in the microstructure.

A martensite structure may be segmented as a fine equiaxed structure by rolling under a condition obtained in the present invention with a deformation temperature range of 575° C. to 625° C., a strain rate range of 0.07 to 0.13 $s^{-1}$, and a strain range of 0.9 to 1.8.

Advantageous Effects

When the present invention is used, ultra-fine grain refinement may be possible at low strain, and thus, production of a high-strength nano titanium alloy may be facilitated and applications of a titanium alloy may be expanded.

BRIEF DESCRIPTION OF THE DRAWINGS

FIG. 1 is an initial equiaxed microstructure and FIG. 2 is a martensite microstructure obtained by water quenching after being maintained at 800° C. for 30 minutes.

MODE FOR CARRYING OUT THE INVENTION

Hereinafter, the present invention will be described in detail.

In order to find an optimum condition for a nanocrystalline titanium alloy, an initial microstructure is induced as martensites having a fine layered structure, and then effects of strain, strain rate, and deformation temperature on the changes in the microstructure are investigated.

Figure 1:
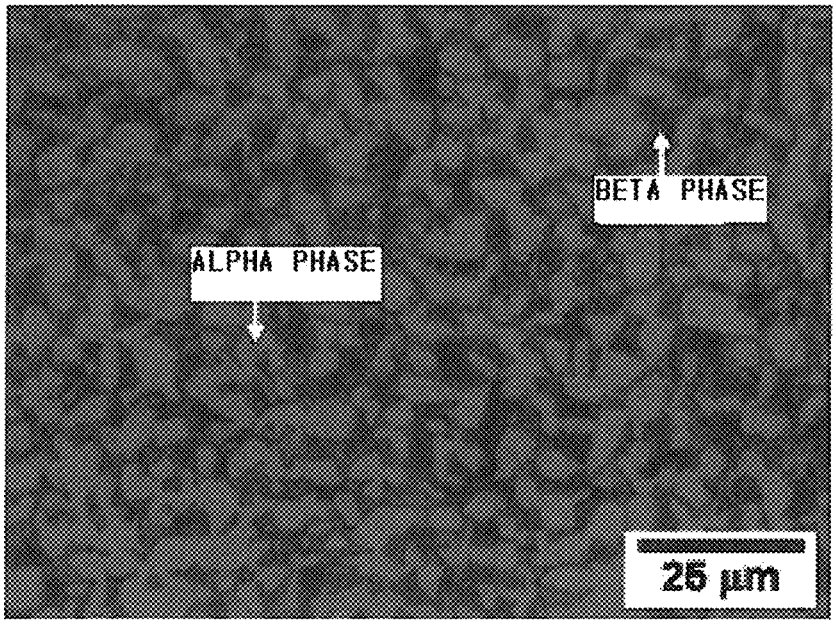
FIGS. 1 and 2 are an initial microstructure and a martensite structure (optical micrographs) of a Ti-13Nb-13Zr alloy, respectively.
Figure 2:
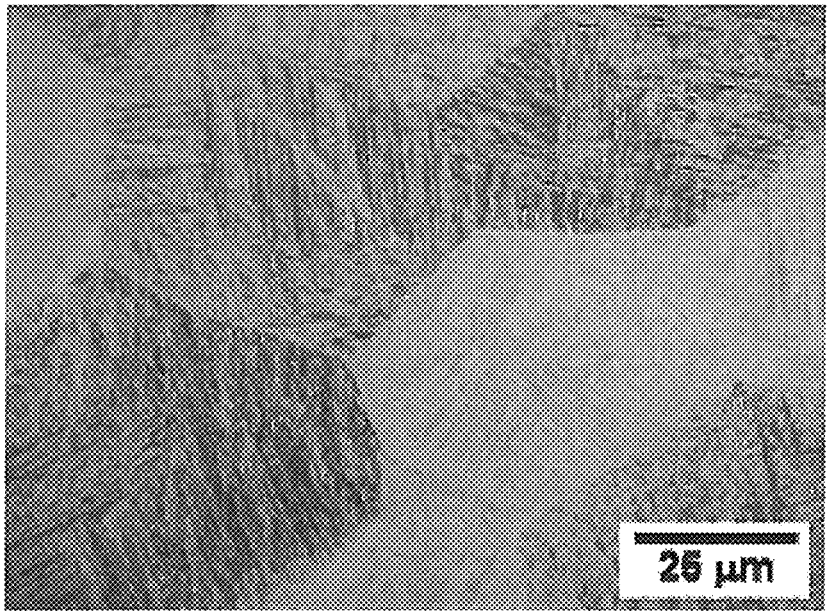

FIGS. 1 and 2 are micrographs obtained by using an optical microscope. FIG. 1 is an initial microstructure of a Ti-13Nb-13Zr alloy which is an equiaxed microstructure having a grain size of 5 μm. The equiaxed microstructure is transformed to a martensite microstructure having a fine layered structure as in FIG. 2 by water quenching after being maintained at 800° C., above a beta transformation temperature (~742° C.), for 30 minutes.

Figure 3:
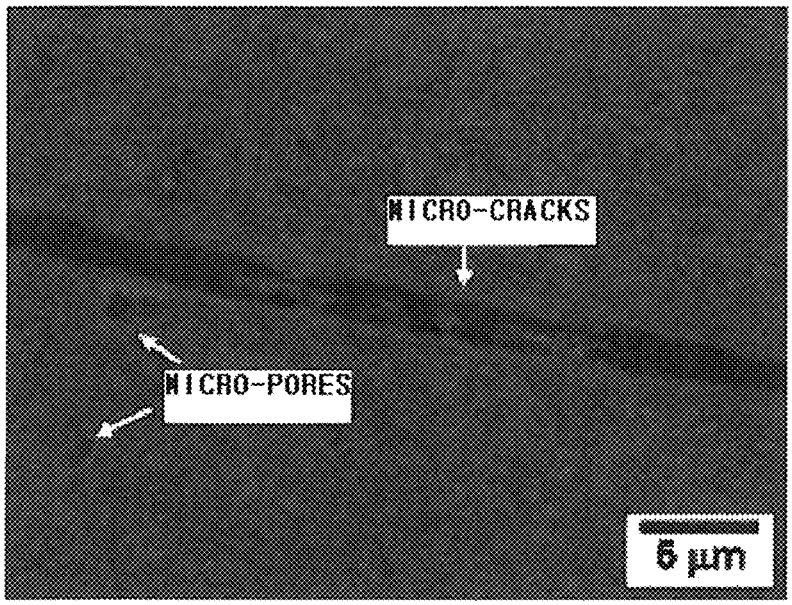
FIGS. 3 to 5 are microstructures (scanning electron micrographs) showing micro-cracks and micro-pores during compression tests of the Ti-13Nb-13Zr alloy having a martensite structure. A process condition of FIG. 3 includes a deformation temperature of 600° C., a strain rate of 1 $s^{-1}$, and a strain of 1.4, a process condition of FIG. 4 includes a deformation temperature of 550° C., a strain rate of 0.1 $s^{-1}$, and a strain of 1.4, and a process condition of FIG. 5 includes a deformation temperature of 550° C., a strain rate of 0.001 $s^{-1}$, and a strain of 1.4.
Figure 4:
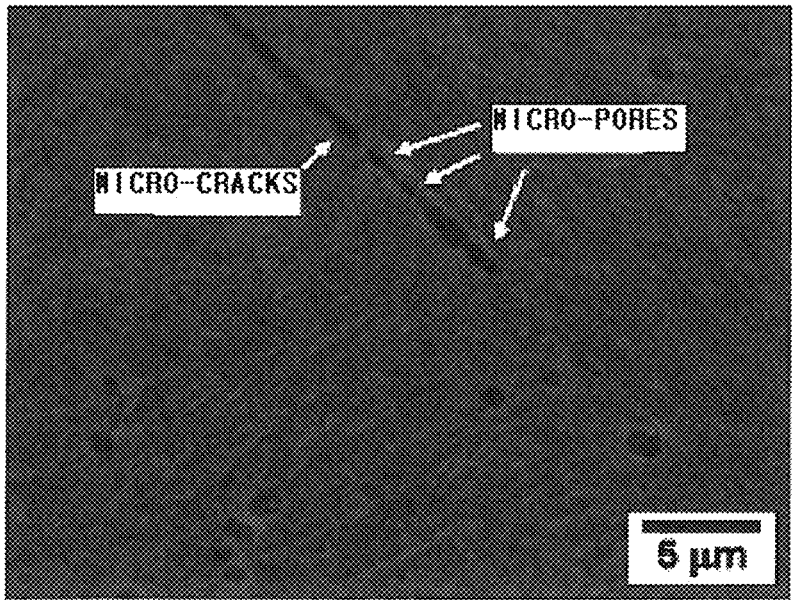
Figure 5:
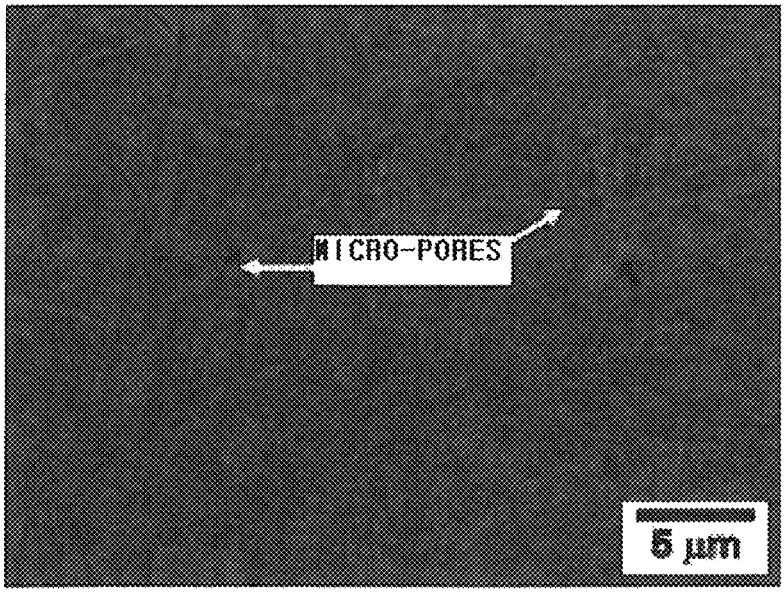

FIGS. 3 to 5 are scanning electron micrographs obtained after compression tests of the Ti-13Nb-13Zr alloy having a martensite structure by varying process conditions. A process condition of FIG. 3 includes a deformation temperature of 600° C., a strain rate of 1 $s^{-1}$, and a strain of 1.4, a process condition of FIG. 4 includes a deformation temperature of 550° C., a strain rate of 0.1 $s^{-1}$, and a strain of 1.4, and a process condition of FIG. 5 includes a deformation temperature of 550° C., a strain rate of 0.001 $s^{-1}$, and a strain of 1.4. When micro-cracks or micro-pores are generated after being deformed as in FIGS. 3 to 5, dynamic spheroidization of the martensite structure may not be effectively performed. As a result, the process conditions of FIGS. 3 to 5 are process conditions which must be avoided to prepare a nanocrystalline titanium alloy.

FIGS. 6 to 9 are scanning electron micrographs obtained after compression tests of the Ti-13Nb-13Zr alloy having a martensite structure under various process conditions, and dark regions denote alpha phases and bright regions denote beta phases. A process condition of FIG. 6 includes a deformation temperature of 600° C., a strain rate of 0.1 $s^{-1}$, and a strain of 1.4, a process condition of FIG. 7 includes a deformation temperature of 700° C., a strain rate of 0.1 $s^{-1}$, and a strain of 1.4, a process condition of FIG. 8 includes a deformation temperature of 600° C., a strain rate of 0.001 $s^{-1}$, and a strain of 1.4, and a process condition of FIG. 9 includes a deformation temperature of 600° C., a strain rate of 0.1 $s^{-1}$, and a strain of 0.8.

Figure 6:
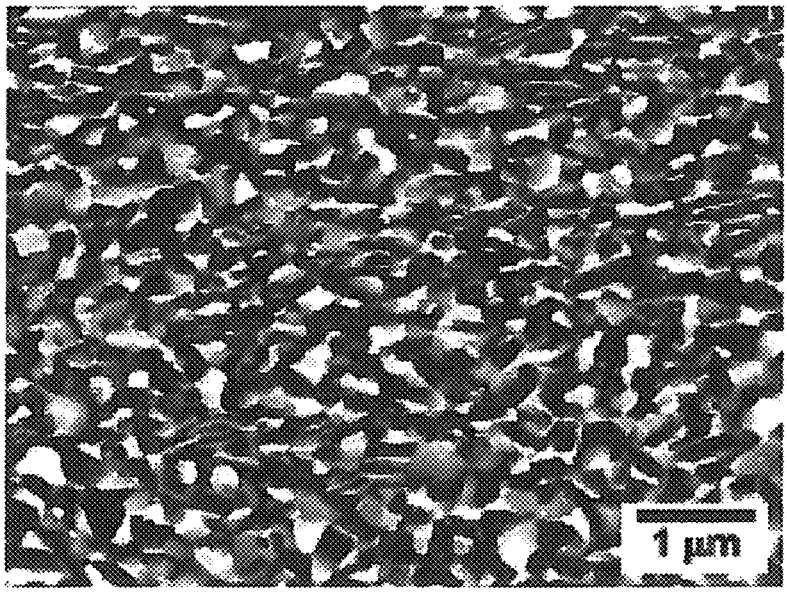
FIGS. 6 to 9 are microstructures (scanning electron micrographs) showing the effects of process variables on the changes in the microstructures during compression tests of the Ti-13Nb-13Zr alloy having a martensite structure. A process condition of FIG. 6 includes a deformation temperature of 600° C., a strain rate of 0.1 $s^{-1}$, and a strain of 1.4, a process condition of FIG. 7 includes a deformation temperature of 700° C., a strain rate of 0.1 $s^{-1}$, and a strain of 1.4, a process condition of FIG. 8 includes a deformation temperature of 600° C., a strain rate of 0.001 $s^{-1}$, and a strain of 1.4, and a process condition of FIG. 9 includes a deformation temperature of 600° C., a strain rate of 0.1 $s^{-1}$, and a strain of 0.8.
Figure 7:
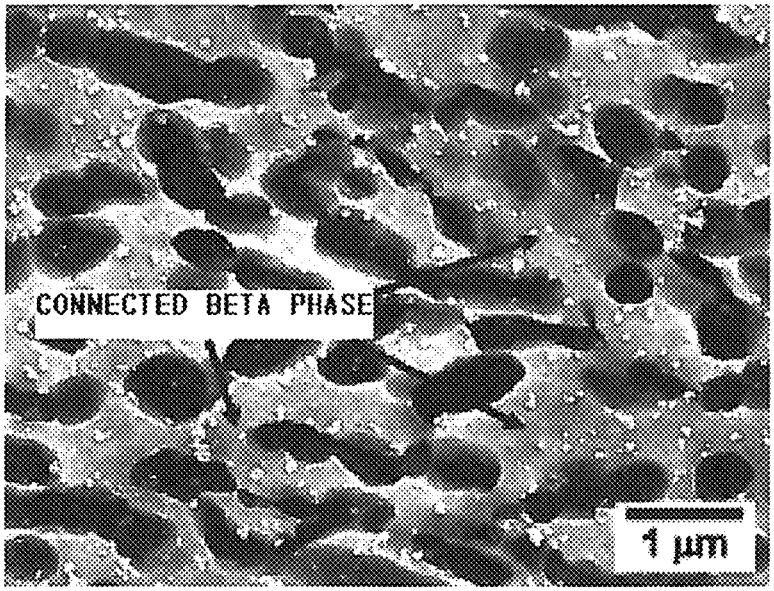
Figure 8:
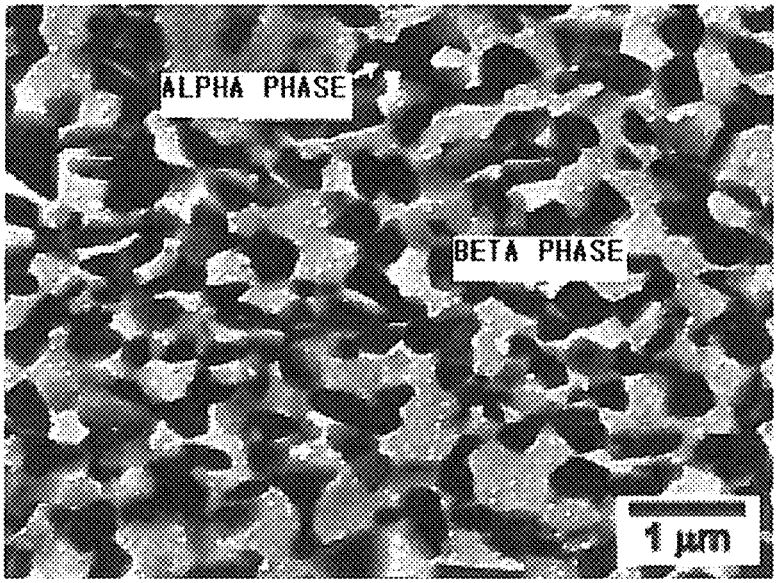
Figure 9:
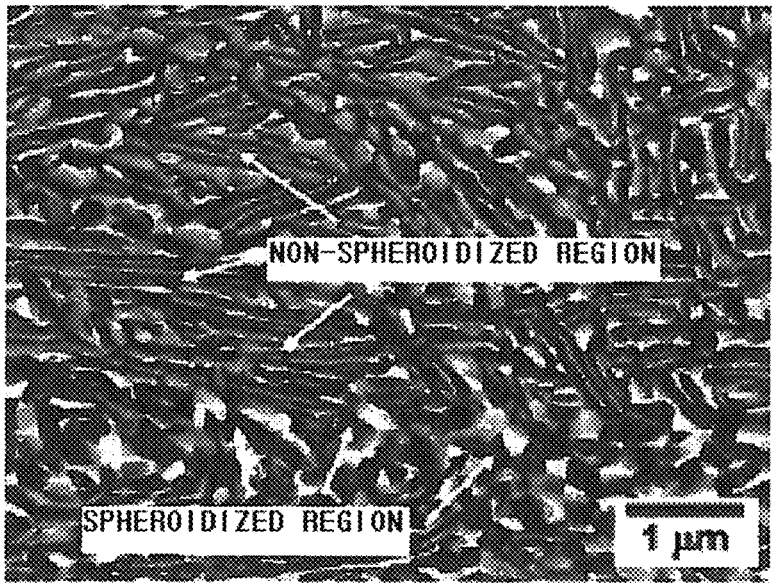

Micro-cracks or micro-pores are not generated under the process conditions described in FIGS. 6 to 9, different from the process conditions described in FIGS. 3 to 5. With respect to FIG. 6, dynamic spheroidization is overall generated such that a layered structure of the martensite structure is entirely segmented into an equiaxed structure, and both alpha phase and beta phase have fine grains having a size of about 300 nm. When FIG. 6 and FIG. 7 are compared, an effect of a process temperature on grain refinement may be understood. When the process temperature increases to 700° C. as in FIG. 7, beta phases, which are not segmented and remain in a connected state, may be observed. However, this is a condition to be avoided in order to prepare a nanocrystalline titanium alloy. When FIG. 6 and FIG. 8 are compared, an effect of a strain rate on grain refinement may be understood. When the strain rate decreases to 0.001 $s^{-1}$ as in FIG. 8, grain growth occurs during dynamic spheroidization because a period of time of being exposed at high temperatures increases, and thus, both alpha phase and beta phase become coarse in comparison to those of FIG. 6. Therefore, this is a condition to be avoided in order to prepare a nanocrystalline titanium alloy. When FIG. 6 and FIG. 9 are compared, an effect of strain on grain refinement may be understood. When the strain is too low of 0.8 as in FIG. 9, some alpha and beta phases may not be dynamically spheroidized and remain in a layered shape as shown in the micrograph. Therefore, this is a condition to be avoided in order to prepare a nanocrystalline titanium alloy.

Meanwhile, in order to investigate mechanical properties of a nanocrystalline titanium alloy, a plate, in which samples may be obtained therefrom, is prepared by rolling the Ti-13Nb-13Zr alloy having a martensite structure, and a process condition at this time is the same as that of the compression test of FIG. 6, i.e., a deformation temperature of 600° C., a strain rate of 0.1 $s^{-1}$, and a strain of 1.4.

Figure 10:
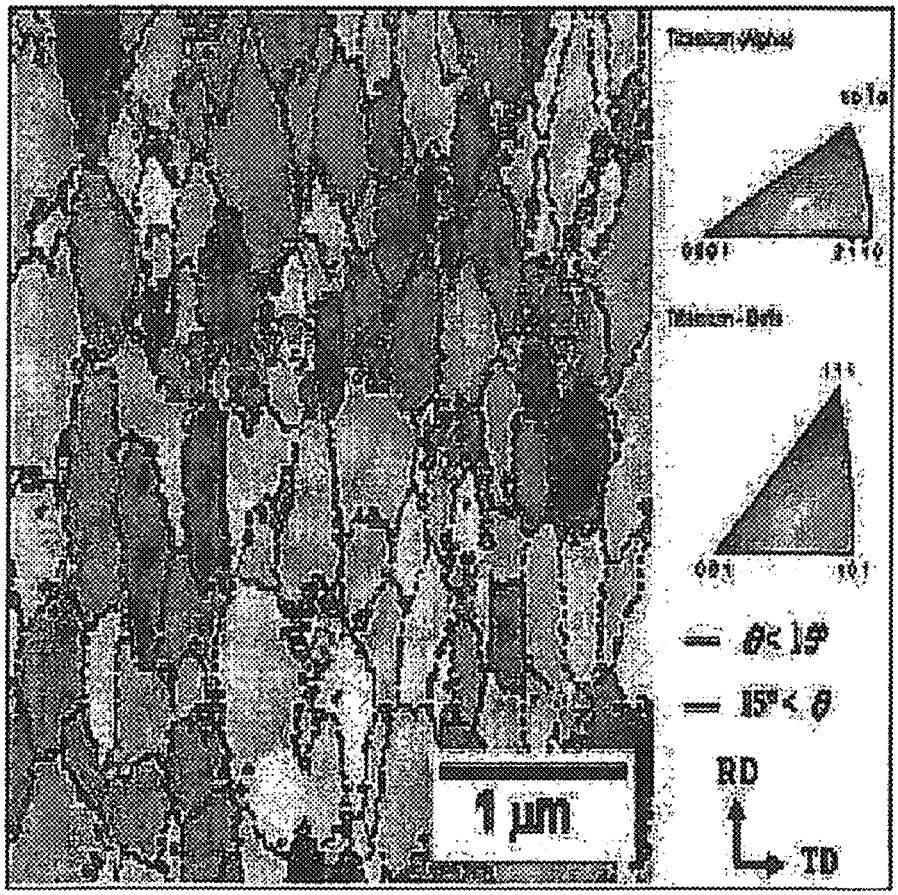
FIG. 10 is inverse pole figures after rolling of the Ti-13Nb-13Zr alloy having a martensite structure and FIG. 11 illustrates fractions of tilt boundaries (back-scattered electron diffraction data) after rolling of the Ti-13Nb-13Zr alloy having a martensite structure.
Figure 11:
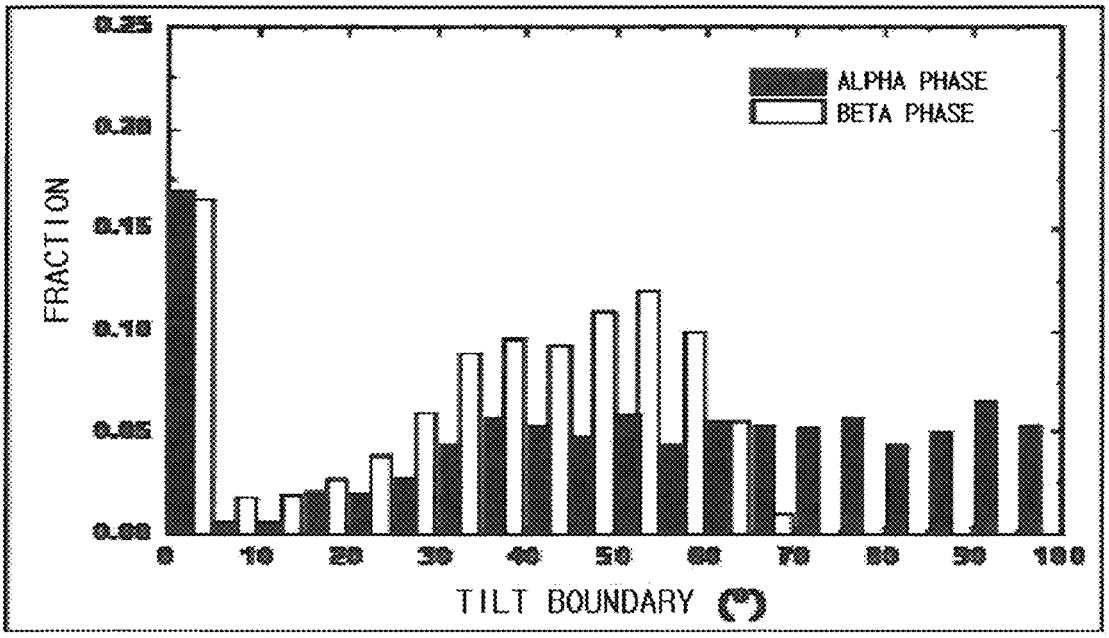

FIG. 10 is inverse pole figures obtained by using a back-scattered electron diffraction detector from the Ti-13Nb-13Zr alloy after rolling, and it may be confirmed that both alpha and beta phases are refined as an equiaxed structure having a size range of 200 nm to 400 nm. FIG. 11 illustrates fractions of tilt boundaries obtained by using the back-scattered electron diffraction detector from the Ti-13Nb-13Zr alloy rolled under the same condition as that of FIG. 10, and it may be understood that high angle boundaries with an angle of 15° or more account for 80% or more. According to the observations of FIGS. 10 and 11, it may be proved that a nanocrystalline Ti-13Nb-13Zr alloy may be obtained by using the method of the present invention at lower strain as compared to that of a typical method.

Meanwhile, tensile properties of a nanocrystalline Ti-13Nb-13Zr alloy prepared by using the method of the present invention are compared with those obtained by an annealing treatment or a solution treatment+an aging treatment and these tensile properties are presented in Table 1.

TABLE 1

| Thermal/mechanical treatment method | Yield strength (MPa) | Tensile strength (MPa) | Elastic modulus (MPa) | Uniform elongation (%) | Fracture elongation (%) | Mechanical compatibility |
|---|---|---|---|---|---|---|
| Annealing treatment | 619 | 718 | 81 | 6.0 | 15.7 | 7.8 |
| Solution treatment + aging treatment | 827 | 902 | 80 | 2.4 | 8.2 | 10.3 |
| Dynamic spheroidization treatment (present invention) | 1010 | 1119 | 78 | 2.7 | 8.4 | 12.9 |

*Mechanical compatibility: yield strength/elastic modulus

The method of the present invention exhibits excellent yield and tensile strengths in comparison to those obtained by the annealing treatment or the solution treatment +the aging treatment, and high strength is obtained without a large decrease in ductility in comparison to that obtained by the annealing treatment or the solution treatment+the aging treatment. Also, mechanical compatibility, a ratio of yield strength to elastic modulus required for a biomaterial, is 12.9, which is improved to about 25% to 60% in comparison to that obtained by the annealing treatment or the solution treatment+the aging treatment.

Industrial Applicability

When the present invention is used, ultra-fine grain refinement may be possible at low strain and thus, production of a high-strength nano titanium alloy may be facilitated and applications of the titanium alloy may be expanded.

The invention claimed is:

1. A method of preparing a nanocrystalline titanium alloy, the method comprising;

segmenting a martensite structure haying a layered structure into a fine equiaxed structure having a size range of 200 nm to 400 nm by rolling under conditions that a deformation temperature ranges from 575° C. to 625° C., a strain rate ranges from 0.07 to 0.13 $s^{-1}$, and a strain ranges from 0.9 to 1.8, wherein a dynamic spheroidization is generated when the layered structure of the martensite structure is entirely segmented into the fine equiaxed structure.

2. The method of claim 1, wherein the deformation temperature is 600° C., the strain rate is 0.1 $s^{-1}$, and the strain is 1.4.

3. The method of claim 1, wherein the martensite structure is obtained from an initial microstructure of a Ti-13Nb-13Zr alloy by water quenching the initial microstructure after being maintained at 800° C. for 30 minutes.

* * * * *